US008568501B2

(12) United States Patent
Kelso

(10) Patent No.: US 8,568,501 B2
(45) Date of Patent: Oct. 29, 2013

(54) TRANSPORTABLE FIELD CONTAINMENT SYSTEM WITH TRANSPARENT HOOD

(75) Inventor: William J. Kelso, Centennial, CO (US)

(73) Assignee: Parsons Corporation, Pasadena, CA (US)

( * ) Notice: Subject to any disclaimer, the term of this patent is extended or adjusted under 35 U.S.C. 154(b) by 271 days.

(21) Appl. No.: 13/083,092

(22) Filed: Apr. 8, 2011

(65) Prior Publication Data

US 2012/0258653 A1 Oct. 11, 2012

(51) Int. Cl.
*B08B 15/02* (2006.01)

(52) U.S. Cl.
USPC .... 55/385.2; 55/356; 55/DIG. 8; 55/DIG. 46; 96/400; 96/402; 96/421; 454/63; 454/187; 128/205.11; 128/205.26; 135/131; 135/139; 135/145; 135/156; 135/157; 135/900; 600/21

(58) Field of Classification Search
USPC ..... 55/385.2, DIG. 8, DIG. 46, 356; 96/400, 96/421, 402; 454/187, 63; 128/205.11, 128/205.26; 600/21; 135/131, 139, 145, 135/156, 157, 900
See application file for complete search history.

(56) References Cited

U.S. PATENT DOCUMENTS

| | | | | |
|---|---|---|---|---|
| 6,338,675 | B2 * | 1/2002 | Winkelman | 454/56 |
| 6,508,850 | B1 * | 1/2003 | Kotliar | 55/385.2 |
| 6,790,257 | B2 * | 9/2004 | Jeng et al. | 95/19 |
| 2007/0094941 | A1 * | 5/2007 | Mintie et al. | 52/63 |
| 2008/0196367 | A1 * | 8/2008 | Ryder et al. | 55/385.2 |
| 2008/0282652 | A1 * | 11/2008 | Wardlaw | 55/385.2 |

* cited by examiner

*Primary Examiner* — Robert Clemente
*Assistant Examiner* — Minh-Chau Pham
(74) *Attorney, Agent, or Firm* — McKenna Long & Aldridge LLP

(57) ABSTRACT

A transportable field containment system with transparent hood. The transportable field containment system being easily and rapidly deployable and transportable by virtue of its relatively small size and light weight, a collapsible transparent hood that covers the containment area over a work site on the ground, the hood including detachable or folding side panels and removable door panels. The system preferably includes an exhaust component that creates negative air pressure in the containment area under the hood, thereby drawing air that contains hazardous substances, that may be released while the work is being conducted, through one or more off-gas filters.

30 Claims, 3 Drawing Sheets

TRANSPORTABLE FIELD CONTAINMENT SYSTEM WITH TRANSPARENT HOOD

FIELD OF INVENTION

The present invention involves a containment system which is employed in the removal and investigation of hazardous substances from the ground. More specifically, the present invention involves a transportable field containment system that includes a transparent hood that more efficiently and effectively facilitates the removal and investigation of hazardous substances from the ground.

BACKGROUND

It seems that hazardous waste sites are frequently discovered in and around military bases and manufacturing facilities, particularly those that existed before the public became environmentally aware of the toxicity of the various substances that were being handled at these locations. Before the Government began regulating these hazardous substances, it was common place to bury these substances underground or store them in containers underground. Over the years, these substances have leached into and contaminated the surrounding soil, exposing the public to these harmful substances. The safe, efficient and effective removal and investigation of these hazardous substances are important environmental and public safety issues. For ease of discussion, the removal, or excavation, and investigation, or sampling, of these substances are individually and collectively referred to herein as "the work."

The current practice, when dealing with these circumstances, is to evacuate a large area around the contaminated site to avoid even greater public exposure to the hazardous compounds or, in some cases, large tent-like structures are erected over and around the contaminated site. These large tent-like structures are often referred to as tension fabric structures. Setting them up and breaking down tensioned fabric structures can be very time consuming and, in some cases, it can take weeks. In addition, they are expensive to purchase, rent and transport.

These tent-like structures are designed to prevent the public from being exposed to hazardous substances. However, they are not designed to protect the remediation technicians that must enter the tent-like structures in order to conduct the work. Accordingly, the remediation technicians must then wear a personal protective ensemble (PPE) that is specially chosen for each application. While the PPE will protect the technician, it is typically cumbersome and uncomfortable, making it difficult for the technician to perform the work.

Finally, these tent-like structures, due in part to their relatively large size, require a great deal of power to operate the equipment necessary to maintain the blower-filtration system used in conjunction with these tent-like structures. Providing the power necessary to operate this equipment can be costly.

The alternative to these large tent-like structures is to evacuate an even larger area around the work site and employ no containment system. Clearly, neither of these solutions is optimal. Accordingly, there is a need for a smaller, more economic structure that is portable, minimizes or eliminates the need to evacuate the zone around the work site, and better protects the technicians that are charged with conducting the work while allowing them to be even more comfortable and productive in conducting the work.

SUMMARY OF INVENTION

The present invention is directed to a transportable field containment system with transparent hood. An exhaust component or sub-system creates negative pressure in the containment area under the hood, thereby drawing air, that may contain hazardous substances, from the containment area away from the remediation technician and through off-gas filters. Unlike the prior art solutions described above, the transportable field containment system with transparent hood, according to the present invention, provides containment and exhaust treatment over a relatively small work site, protects the remediation technician, can be set up and broken down in less than an hour, and is man-portable.

In general, the present invention provides engineering control for the protection of workers and the general public. The engineering control provides this protection by detecting, containing and filtering hazardous analytes that might be released while the work is being conducted. Engineering control provides a higher level of compliance with OSHA regulations than other forms of control, such as work practice control, which might involve the use of exclusion zones (evacuation areas) and contamination reduction zones, or the use of PPE. In accordance with exemplary embodiments of the present invention, negative air pressure is maintained in a containment area under the transparent hood. This, in turn, ensures that any directional air movement is from the clean air environment outside the hood, into the containment area, and not the reverse. The exhaust from the hood is directed to a filter-blower system, for example, a carbon filter-blower system, which treats the contaminated air. In this regard, the hood provides protection for the remediation technician because he or she is able to perform the excavation from outside the hazardous containment area, without having to wear a cumbersome hazmat suit.

One advantage of the transportable field containment system with transparent hood, according to exemplary embodiments of the present invention, is that it is relatively small and man-transportable.

Another advantage of the transportable field containment system with transparent hood, according to exemplary embodiments of the present invention, is that it minimizes the evacuation zone around the work site.

Still another advantage of the transportable field containment system with transparent hood, according to exemplary embodiments of the present invention, is that it requires much less power than current systems, due its relatively small size.

Yet another advantage of the transportable field containment system with transparent hood, according to exemplary embodiments of the present invention, is that it is relatively less costly to operate due, in part, to the aforementioned reduced power requirements, and due to the fact that it is easily transportable and, therefore, repeatedly reusable.

Another advantage of the transportable field containment system with transparent hood, according to exemplary embodiments of the present invention, is that it provides greater protection for the remediation technician who works outside the containment area in a clean environment.

Another advantage of the transportable field containment system with transparent hood, according to exemplary embodiments of the present invention, is that it allows the remediation technician to work without wearing a cumbersome hazmat suit. This increases worker productivity, decreases labor cost, and eliminates safety hazards associated with the suit such as limited visibility and heat exposure.

In accordance with one aspect of the present invention, the aforementioned and other advantages are achieved by a transportable field containment system. The system comprises an exhaust component and a transparent hood. The transparent hood is capable of covering a containment area over a work site on the ground. The transparent hood comprises a front panel having an opening there through and one or more door panels capable of closing the opening.

In accordance with another aspect of the present invention, the aforementioned and other advantages are achieved by a transparent hood for use in a transportable field containment system. The hood covers a containment area over a work site on the ground and it comprises a front panel having a containment area access opening there through; a plurality of side panels attached to the front panel; and one or more door panels capable of closing the opening.

BRIEF DESCRIPTION OF DRAWINGS

The present invention will be understood, in part, from the following figures, in which.

DETAILED DESCRIPTION OF INVENTION

The present invention will now be described in terms of a preferred embodiment. However, it will be understood that the embodiment, though preferred, is exemplary. Those of ordinary skill in the art will understand that certain modifications to the preferred embodiment are possible without departing from the spirit of the invention. Such modifications are, therefore, considered within the scope of the present invention.

Figure 1:
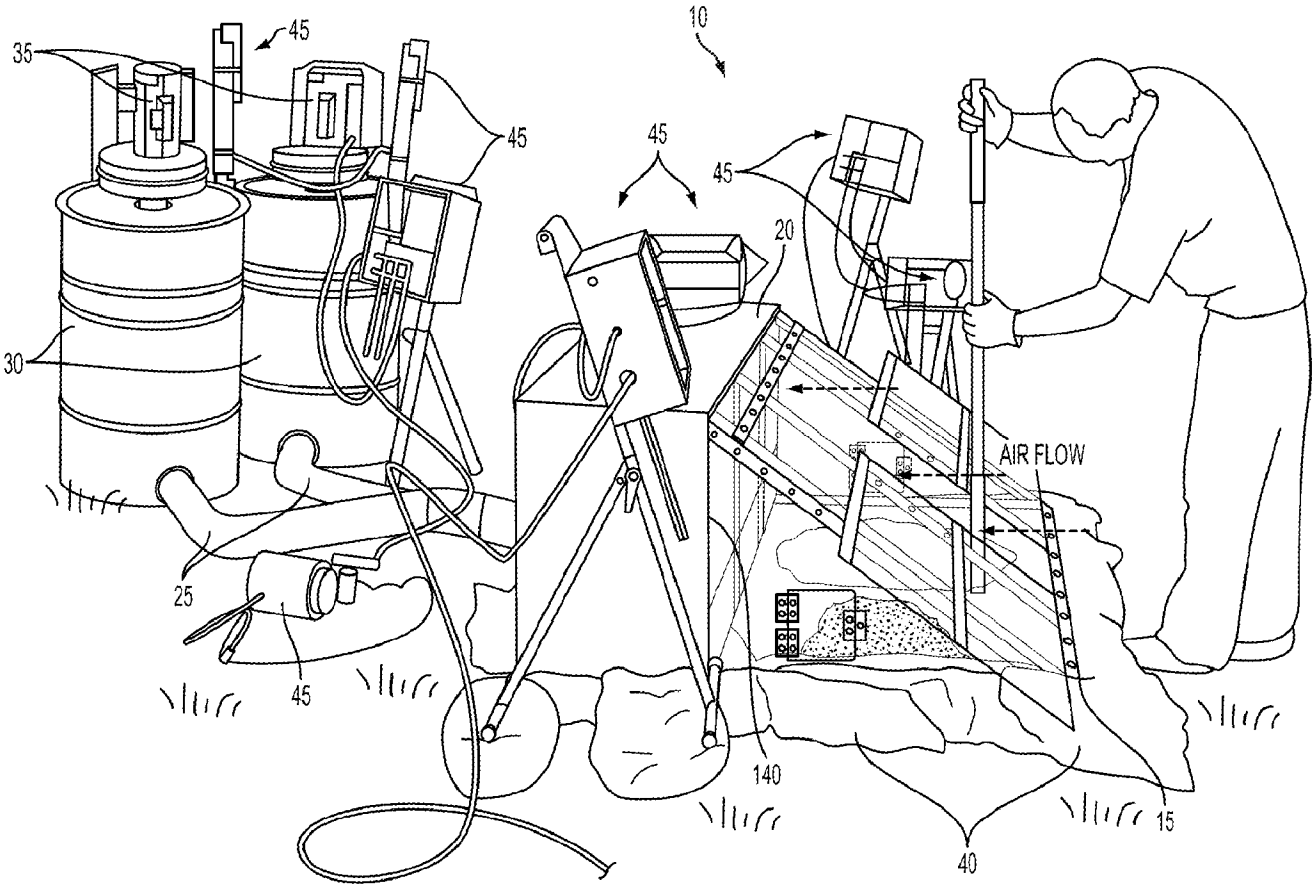
FIG. 1. illustrates an overview of a transportable field containment system with transparent hood, in accordance with a preferred embodiment of the present invention.

FIG. 1 illustrates the main components of a transportable field containment system 10 with transparent hood, in accordance with the preferred embodiment of the present invention. As shown, the system comprises, among other things, a transparent hood 15, an exhaust plenum 20, exhaust hose 25, off-gas filters 30, exhaust blowers 35 and sealing skirt 40. In addition, there are one or more monitoring devices 45 that are better illustrated in FIG. 3, which is described in more detail below.

Figure 2:
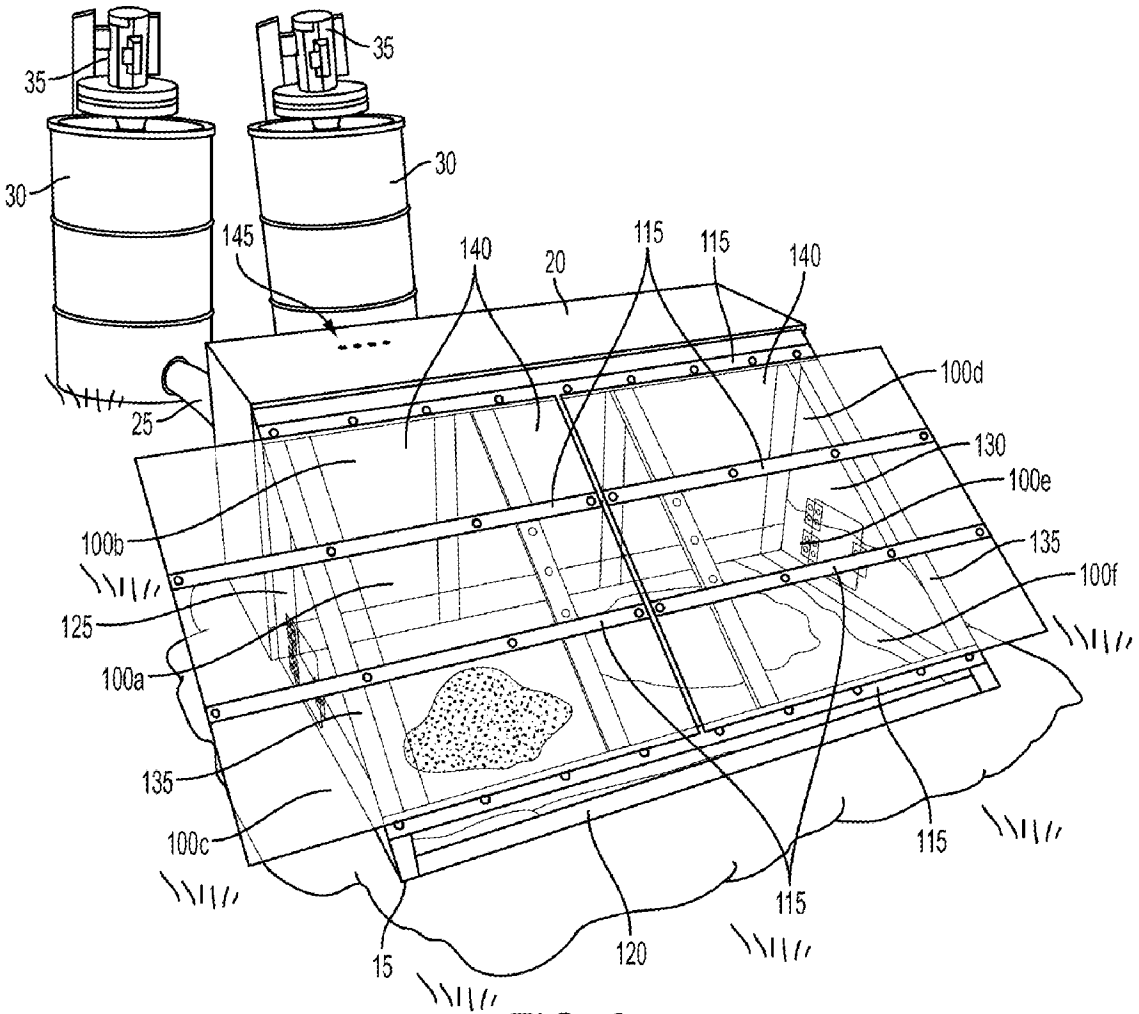
FIG. 2 illustrates the transparent hood in greater detail, in accordance with the preferred embodiment of the present invention.

FIG. 2 shows, in greater detail, the transparent hood 15. In general, the hood 15 covers and, therefore, isolates the containment area under the hood from the clean environment outside the hood. The hood 15 is physically separable from the other system components. This contributes to the transportability of the system as a whole.

In the preferred embodiment, the hood 15 is made of a non-ferrous, non-magnetic, heavy duty, yet lightweight plastic, such as clear polycarbonate. This permits the remediation technician and/or others to view the containment area under the hood 15 from many different angles, yet remain outside the containment area, protected from any hazardous substances while performing the work.

Further, in accordance with the preferred embodiment, the hood 15 comprises a plurality of sliding door panels 100. In this embodiment, there are six sliding door panels 100(*a*)-100(*f*), three sliding door panels 100(*a*)-100(*c*) on the left and three sliding door panels 100(*d*)-100(*f*) on the right. It will be appreciated, however, that more than six or fewer than six door panels are possible.

While installed, the door panels 100 rest in tracks 115. The tracks 115 permit the remediation technician to slide each of the door panels 100 horizontally and independently. Because the technician can independently slide each of the door panels 100, there are infinite degrees of freedom with respect to the horizontal positioning of the door panels, relative to each other. Therefore, the size of the opening in the hood, through which the technician has access to the containment area, is adjustable. It will be further noted that more than one opening through the hood and other configurations for mounting and adjusting the position of the door panels are possible.

In accordance with the preferred embodiment, the door panels 100 are also removable. That is, the technician can slide each of the door panels 100 horizontally until they are free of the tracks 115 and completely detached from the hood 15. The ability to remove and then stack the door panels 100 allows the hood 15 to be disassembled easily and quickly, and this, in turn, further facilitates transportability.

Still further in accordance with the preferred embodiment, the hood 15 comprises a front panel 120 and side panels 125 and 130. In addition, the side panels 125 and 130 are rotatably attached to the front panel 120 by hinged edge brackets 135. These hinged edge brackets permit the technician to fold the side panels 125 and 130 relative to the front panel 120 so that the hood is collapsible and essentially flat when disassembled, even further facilitating transportability of the hood and the system as a whole. Alternatively, the side panels 125 and 130 may be detachable from the front panel 120. The ability to detach the side panels 125 and 130 from the front panel 120 would also facilitate transportability.

FIG. 2 also shows, in greater detail, the exhaust plenum 20. The exhaust plenum 20 is a transition component positioned adjacent to the hood 15. The exhaust plenum 20 serves as an outlet through which air is drawn from the containment area under the hood 15 and directed towards the exhaust hose 25. In the preferred embodiment, the plenum 20 and the hood 15 are configured in such a way that there is no leakage of air there between when the two components are assembled and the system is functioning. For example, the outer portion or periphery of the side surface of plenum 20 facing the transparent hood 15 may include a groove having a size and/or shape designed to accommodate the rear edge of the transparent hood, thus providing a seal between transparent hood 15 and the plenum 20 to prevent the leakage of air.

The plenum 20 is further configured to house one or more filters 140. In the preferred embodiment, the filters 140 are made of fabric. The filters 140 remove dust and other relatively large particles from the air before the air enters the off-gas filters 30. When dirty or damaged, the technician can remove the filters 140 from the plenum 20 and either clean or replace the filters 140.

The plenum 20 also includes one or more ports. In the preferred embodiment, one or more x-grommet port 145 are located on the top side of the plenum 20. The port 145 serves as an insertion point for air monitoring sensors and/or other instruments necessary for monitoring the conditions in the containment area. More will be said about the air monitoring sensors below.

Referring back to FIG. 1, the transportable field containment system 10 comprises exhaust and filtration components, including an exhaust hose 25, off-gas filters 30, and exhaust blowers 35. In the preferred embodiment illustrated in FIG. 1, there are two off-gas filters 30 and two exhaust blowers 35. One skilled in the art, however, will realize that more or less than two off-gas filters 30 and more or less than two exhaust blowers 35 are possible.

Each of the two exhaust blowers 35 comprises, for example, an electric motor and a fan. In FIG. 1, each of the two exhaust blowers 35 are located on a respective one of the off-gas filters 30. When the exhaust blowers 35 are operating, they create negative air pressure in the containment area under the hood 15, thereby drawing air from the containment area under the hood 15, through the fabric filters 140 in the plenum 20, through the exhaust hose 25 and into and through the two off-gas filters 30. The negative air pressure actually causes air movement from the outside, clean environment into the containment area under the hood 15. The movement of air into the containment area from the outside, clean environment is illustrated in FIG. 1 by the dashed arrows. Maintaining the movement of air in this direction is important because it not only facilitates the removal of dirt and dust particles from the air, and the removal of hazardous substances from the air, it also protects the technician by continuously moving these hazardous substances in a direction away from the technician.

In an alternative embodiment, the power and/or speed of the exhaust blowers 35 is variable. In other words, the exhaust blowers 35 are adjustable. For example, if the technician increases the size of the opening through the front panel 120 by sliding open one or more of the door panels 100, and the exhaust blowers 35 are not adjustable, the air pressure in the containment area may drop. However, if the exhaust blowers 35 are adjustable, the exhaust blowers 35 may work harder or faster in response to the drop in negative air pressure, thereby maintaining the desired level of negative air pressure and minimizing the risk of any hazardous substances escaping from the containment area and jeopardizing the safety of the technician. In one embodiment, the exhaust blowers 35 may be manually adjustable. In another embodiment, the exhaust blowers 35 may be automatically variable based on a feedback signal from the air pressure monitor described below.

In the preferred embodiment, the off-gas filters 30 take the form of canisters, each of which contain carbon. As the air passes through the carbon, the carbon treats the exhaust by removing any hazardous substances in the exhaust. Although it is not shown in FIG. 1, each of the off-gas carbon filters 30 may have wheels or casters to further facilitate the transportability of the system as a whole.

One reason there are two off-gas filters 30 and two exhaust blowers 35 in the preferred embodiment is that having more than one off-gas filter 30 and one exhaust blower 35 insures at least single-fault tolerance. In other words, if one blower fails while the work is being conducted, there is some redundancy in that at least one exhaust blower remains operational to maintain the air flow in the aforementioned direction, from the outside, clean environment to the containment area, away from the technician, thereby minimizing the risk of exposing the remediation technician to hazardous substances in the air within the containment area.

In accordance with the preferred embodiment of the present invention, the transportable field containment system 10 with transparent hood further includes a sealing skirt 40, as illustrated in FIG. 1. The primary purpose of the sealing skirt 40 is to prevent air from leaking through any space between the ground and the underside of the transparent hood 15, due in part to any unevenness of the ground, which might otherwise adversely affect the negative air pressure in the containment area.

Preferably, the shape of the sealing skirt 40 is adaptable so that it compliments the contour of the ground below the hood 15 and around the plenum 20. The sealing skirt 40 can then fill all of the open space that might otherwise exist between the ground and the hood 15. In the exemplary embodiment of FIG. 1, the sealing skirt 40 comprises one or more sandbags; however, one skilled in the art will appreciate the fact that the sealing skirt 40 may involve something other than sandbags.

Figure 3:
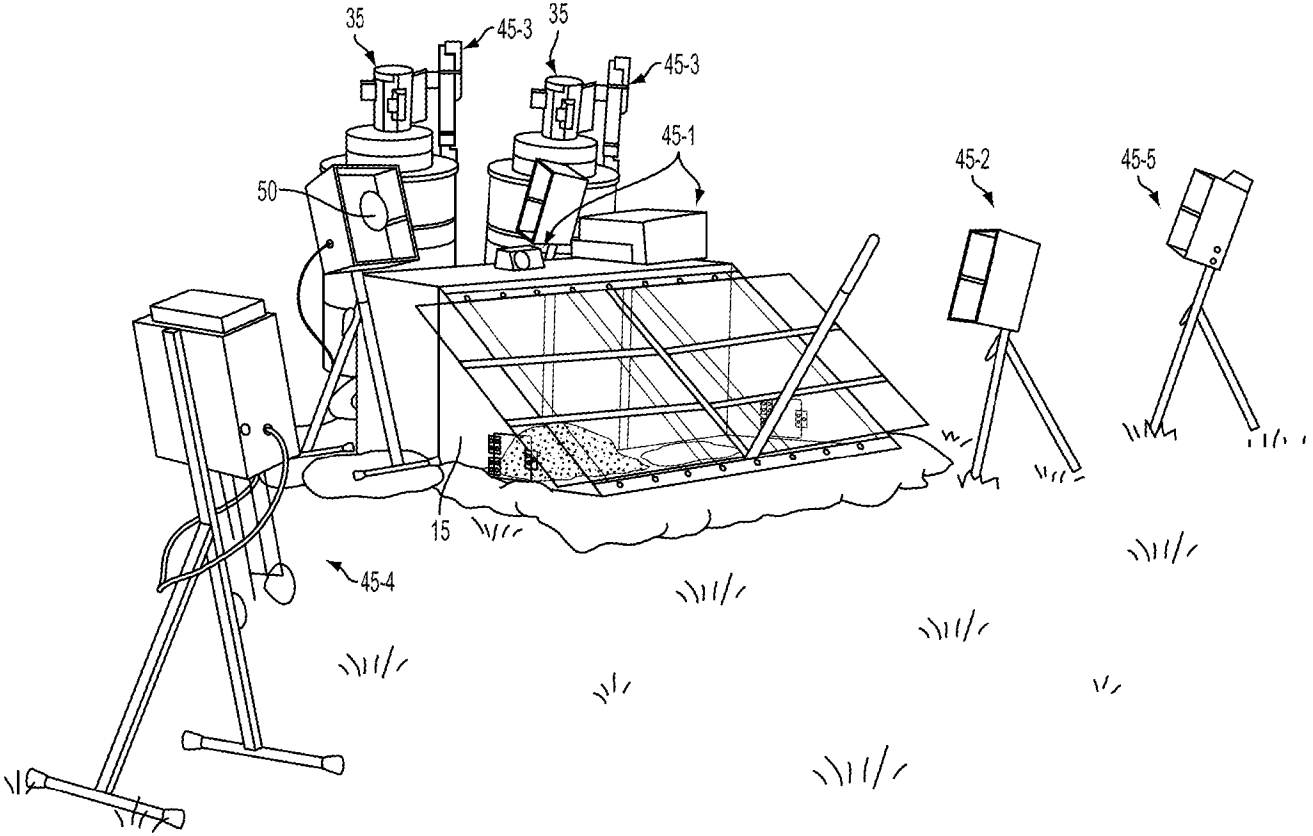
FIG. 3 illustrates a number of monitoring devices that may be employed in the transportable field containment system.

FIG. 3 illustrates an exemplary number of monitors 45. The monitors 45 are primarily used to detect the presence of one or more hazardous analytes and activate an alarm if any of these analytes are in fact detected. The monitors include a first monitor 45-1 for monitoring the conditions in the containment area under hood 15 and activating an alarm if one or more hazardous analytes are detected. A second monitor 45-2 is employed for monitoring the work zone immediately outside the containment area. The primary purpose of monitor 45-2 is to protect the technician performing the work by activating an alarm if certain hazardous analytes are detected outside the containment area in the work space around the technician. A third monitor 45-3 is used for monitoring the exhaust, that is, monitoring the exhaust gas after it passes through the off-gas filters 30 to verify the effectiveness of the off-gas filters 30 for removing the target analytes. A fourth monitor 45-4 is for monitoring an area downwind of the work zone, while a fifth monitor 45-5 is for monitoring an area upwind of the work zone. The purpose of monitors 45-4 and 45-5 is to protect the general population in close proximity to the work zone by activating an alarm if any analyte migrates outside the work zone. There are known instruments that may be used for the monitors 45-1 through 45-5. Although the embodiment illustrated in FIG. 3 shows five monitors, one skilled in the art will understand that more or fewer monitors may be employed.

FIG. 3 also shows that, in accordance with the preferred embodiment of the present invention, the transportable field containment system 10 with transparent hood further comprises a pressure gauge 50. There are also known instruments for implementing the pressure gauge 50. In one exemplary embodiment, the pressure gauge 50 is connected to a pressure transducer located in the containment area under the transparent hood 15. The purpose of pressure gauge 50 is allow the technician to continuously monitor the air pressure in the containment area under the hood 15, to insure that the exhaust fans 35 are maintaining the negative air pressure. The pressure gauge 50 may activate an alarm if it determines that the air pressure drops below a predetermined threshold. As explained above, maintaining negative air pressure in the containment area provides protection by isolating the technician from any hazardous substances in the air within the containment area.

The present invention has been described in accordance with a preferred embodiment, including certain alternatives thereto. One skilled in the art will understand that other modifications and embodiments consistent with the scope and spirit of the present invention are possible.

I claim:

1. A transportable field containment system comprising:

an exhaust component; and a transparent hood capable of covering a containment area over a work site on the ground and configured to protect a worker whom is working at the work site from outside the containment area, said transparent hood comprising:

a front panel having an opening there through to access the work site; and one or more door panels capable of closing the opening.

2. The system of claim 1, wherein the transparent hood is collapsible.

3. The system of claim 2, wherein said transparent hood further comprises:

at least two side panels rotatably attached to the front panel by a hinge.

4. The system of claim 2, wherein said transparent hood further comprises:

at least two side panels that are detachably joined to the front panel.

5. The system of claim 1, wherein the transparent hood further comprises:

one or more tracks, wherein each of the one or more door panels are slidably arranged in the one or more tracks.

6. The system of claim 5, wherein each of the one or more door panels is removable with respect to the front panel.

7. The system of claim 5, wherein the size of the opening in the front panel is adjustable based on the positioning of the one or more doors.

8. The system of claim 1, wherein the exhaust component comprises:

an exhaust plenum adjacent to the transparent hood;

one or more exhaust hoses;

one or more off-gas filters, wherein each of the one or more exhaust hoses connects the exhaust plenum to a respective one of the one or more off-gas filters; and one or more exhaust blowers, wherein each of the one or more exhaust blowers is connected to a respective one of the one or more off-gas filters, and wherein each of the one or more exhaust blowers is configured to draw air from the containment area through the exhaust plenum, the one or more exhaust hoses and the one or more off-gas filters, thereby generating a negative air pressure in the containment area under the transparent hood.

9. The system of claim 8, wherein the exhaust plenum comprises:

at least one fabric filter.

10. The system of claim 8, wherein the one or more off-gas filters are carbon filters.

11. The system of claim 8, wherein the one or more exhaust blowers are adjustable.

12. The system of claim 11, wherein the one or more exhaust blowers are manually adjustable.

13. The system of claim 11, wherein the one or more exhaust blowers are automatically adjustable based on a feedback signal from an air pressure monitoring device capable of detecting the air pressure in the containment area under the transparent hood.

14. The system of claim 1 further comprising at least one monitoring device.

15. The system of claim 14, wherein the at least one monitoring device is an air pressure monitor that includes a pressure transducer located in the containment area under the transparent hood.

16. The system of claim 14, wherein the at least one monitoring device is a hazardous analyte monitor located upwind from a work zone adjacent the front panel of the transparent hood.

17. The system of claim 14, wherein the at least one monitoring device is a hazardous analyte monitor located downwind from a work zone adjacent the front panel of the transparent hood.

18. The system of claim 14, wherein the at least one monitoring device is a hazardous analyte monitor located in a work zone adjacent to the transparent hood.

19. The system of claim 14, wherein the at least one monitoring device is a hazardous analyte monitor associated with the exhaust component.

20. The system of claim 14, wherein the at least one monitoring device is a hazardous analyte monitor located in the containment area under the transparent hood.

21. The system of claim 1 further comprising:

a sealing skirt positioned between a bottom portion of the transparent hood and the ground.

22. A transparent hood for use in a transportable field containment system, wherein said hood covers a containment area over a work site on the ground, said transparent hood comprising:

a front panel having a containment area access opening there through;

a plurality of side panels attached to the front panel; and one or more door panels capable of closing the opening, wherein the transparent hood is configured to protect a worker whom is working at the work site from outside the containment area.

23. The hood of claim 22, wherein the hood is collapsible.

24. The hood of claim 23, wherein each of the plurality of side panels is rotatably attached to the front panel by a hinge.

25. The hood of claim 23, wherein each of the plurality of side panels is detachably joined to the front panel.

26. The hood of claim 22 further comprising:

one or more tracks, wherein each of the one or more door panels is slidably arranged in the one or more tracks.

27. The system of claim 26, wherein each of the one or more door panels is removable with respect to the front panel.

28. The system of claim 26, wherein the size of the containment area access opening through the front panel is adjustable based on the positioning of the one or more doors.

29. The hood of claim 22, wherein the hood comprises a non-ferrous, non-magnetic, relatively light weight, heavy duty plastic.

30. The hood of claim 29, wherein the hood comprises clear polycarbonate.

* * * * *